United States Patent [19]

Karakawa

[11] 4,054,165

[45] Oct. 18, 1977

[54] GROOVED SHEET MATERIAL

[75] Inventor: Takuji Karakawa, Fuchu, Japan

[73] Assignee: Karakawa Fancy Plywood Works Ltd., Japan

[21] Appl. No.: 553,946

[22] Filed: Feb. 28, 1975

[30] Foreign Application Priority Data

Mar. 14, 1974 Japan ..... 49-29752

[51] Int. Cl.[2] ..... B27C 5/00

[52] U.S. Cl. ..... 144/136 R; 144/133 R; 83/5

[58] Field of Search ..... 144/136 R, 133 R, 312; 83/5

[56] References Cited

U.S. PATENT DOCUMENTS

| | | | |
|---|---|---|---|
| 3,036,605 | 5/1962 | Joa | 144/133 R |
| 3,259,157 | 7/1966 | Runnion | 144/312 |
| 3,470,924 | 10/1969 | Short | 144/136 R |
| 3,616,826 | 11/1971 | Murphey et al. | 144/136 |
| 3,672,415 | 6/1972 | Holan | 144/136 R |

*Primary Examiner*—Donald R. Schran

*Attorney, Agent, or Firm*—William A. Drucker

[57] ABSTRACT

The invention provides a method, and apparatus for carrying out the method, of preparing a sheet material having two sets of grooves disposed one across the other, one set of grooves being continuous and the other set of grooves being formed in an intermittent and alternated manner simulating ladder pattern or brickwork. The material may be a simple sheet, especially chipboard or hardboard, or a laminated sheet prepared with strip material secured on a base, especially strip wood on a veneer or paper base.

4 Claims, 5 Drawing Figures

GROOVED SHEET MATERIAL

BACKGROUND OF THE INVENTION

It is already known to provide sheet material, especially for indoor use as a wall or ceiling covering, which comprises a substantially rigid sheet having on a major face thereof a series of grooves which are parallel to each other and which are of equal spacing. The grooves simulate planking, or otherwise give a pleasing decorative effect, and may also serve for better anchoring of other surface treatment material applied to the sheet.

The grooves have hitherto been provided in the sheet material by passing an uncut sheet over a plurality of circular saws arranged in side-by-side axially spaced position. Usually, the grooves have been provided parallel to the longer median axis of a sheet of greater length than width.

It is desirable to provide, on such sheet material, other grooving which extends transversely, say at right angles, to the longitudinal grooving. For example, by grooving the lands between adjacent longitudinal grooves, a step-like or ladder-like, pattern can be obtained, simulating the appearance which is obtained when bricks or blocks are laid or secured on a base in horizontal rows, and the gaps between the individual bricks or blocks of each row are purposely displaced laterally with respect to the gaps between the bricks or blocks of the next superjacent and next subjacent rows.

Owing to the intermittent nature of such transverse grooves, and the fact that they must terminate neatly at each end exactly at the position where they meet the longitudinal grooves, it has hitherto been impossible to provide such transverse grooves by adoption or modification or the conventional method of cutting grooves by passing the sheet over a set of circular saws. For example, if the sheet, with longitudinal grooves already formed therein, was merely rotated through 90° about its centre point, and then passed again over the same set of circular saws, there would be obtained merely another set of grooves which passed completely across the sheet from side to side, and intersecting all of the longitudinal grooves to give a cross-hatch pattern, quite different from that desired. Further, even if the same circular saws are moved into and out of engagement with the sheet, in an effort to cut intermittent transverse grooves, the places where the saws make contact and leave contact with the sheet are "starts" and "finishes" which vary from nil depth to maximum depth and give an unsightly appearance.

SUMMARY OF THE INVENTION

It is a primary object of the invention to provide a method of preparing a grooved sheet material which has in it a first set of parallel spaced grooves running in a first direction, and a second set of spaced parallel grooves running intermittently in a second transverse direction, the second grooves being so formed that at least one of said second grooves is intermittent and is formed in a first series of alternately spaced lands of the major face of the sheet, at least another of said second grooves being intermittent and being formed in a second series of alternately spaced lands disposed intermediate the lands of said first series of lands.

Another object of the invention is to provide a machine for carrying out the above described method in the formation of grooved sheet material.

A still further object is to provide an improved sheet material having transversely disposed sets of grooves in the manner described, and especially for the purpose of simulating ladder or step pattern blocks or bricks.

DESCRIPTION OF THE PREFERRED EMBODIMENT.

A sheet having parallel longitudinal grooves has generally been known in the past. This, however, has grooves prepared only in a single direction. As a wall covering material, such a sheet is generally used in such a manner that said grooves would be in the vertical direction. This was done mainly for the purpose of producing a feeling that the sheet was placed in the vertical direction. Since the grooves were only in a single direction, the use of the sheet was naturally restricted and it lacked the capacity of being used for widely differing purposes.

Such a situation has developed in the past because of the fact that longitudinal grooves parallel to each other can easily be prepared on a sheet by causing the sheet to pass, under pressure, over circular saws which rotate and which are provided at a fixed axial distance from each other. However, it has been mechanically impossible to form alternating transverse grooves by producing grooves in the transverse direction at a given distance from one another on each single sheet, and the problem has remained unsolved for a long time hitherto.

As the result of careful examination of this problem, the present invention renders it possible to prepare, with high efficiency, such sheets with two sets of grooves at right angles.

In carrying out this invention, the providing of parallel grooves in a first direction on a sheet, and the coating of said grooves with paint, can be carried out by a method which has been known widely in the past.

Figure 1:
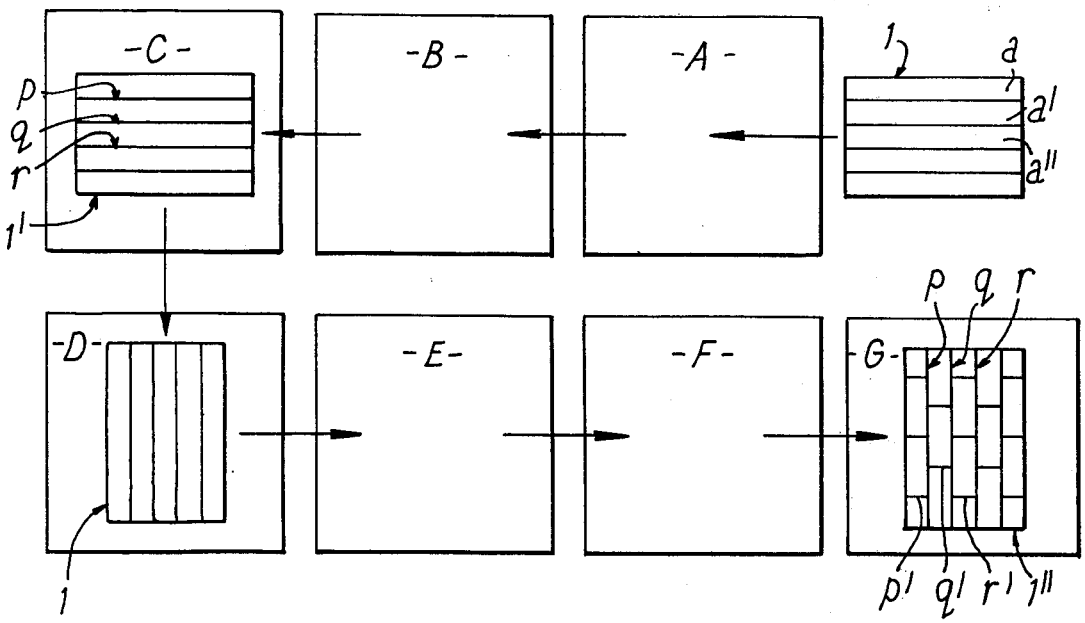
FIG. 1 is a flow diagram to show stages of the method of the invention.

In FIG. 1, reference numeral 1 denotes a sheet which has been prepared by placing thin single strips of wood or other material, *a, a', a''*, . . . . of narrow width on a veneer sheet, one by one and aligned in the same direction, and glueing them to form a whole having a greater width. While being passed through the method stage A, the sheet has a large number of parallel longitudinal grooves *p, q, r*, . . . . formed in it by means of circular saws installed at fixed axial spacings for the purpose of producing grooves at desired locations. In method stage B, the longitudinal grooves *p, q, r*, . . . . are coated with paint.

The two stages which have been described above are the same as those already known in the art for the preparation of grooves. According to the method of this invention, however, the sheet, provided with longitudinal grooves in the manner described above, is then provided with transverse grooves prepared thereon and crossing the longitudinal grooves at a right angle, in an intermittent and laterally offset manner which will be best seen in FIG. 5, and which simulates the appearance of laid bricks or blocks.

The sheet 1' leaving method stage C, after the longitudinal grooves *p, q, r,* . . . . have been prepared, is redirected in a direction which is at a right angle to that adopted in said stage C, and is forwarded to the stage D. Stage D serves for forwarding the sheets 1', which have been given longitudinal grooves, one by one to stage E.

In stage E, there is provided a device for preparation of transverse intermittent grooves which cross the lands defined between adjacent longitudinal grooves. After leaving stage E, the sheets on which the crossed transverse grooves have been provided are forwarded to stage F, where the transverse grooves are painted and, after the product has been finished, it is forwarded to a delivery stage G.

An apparatus for carrying out method stages D, E and F, which are different from those of the conventional method, will be hereinafter described in detail with reference to FIGS. 2 to 5 of the drawings.

Figure 2:
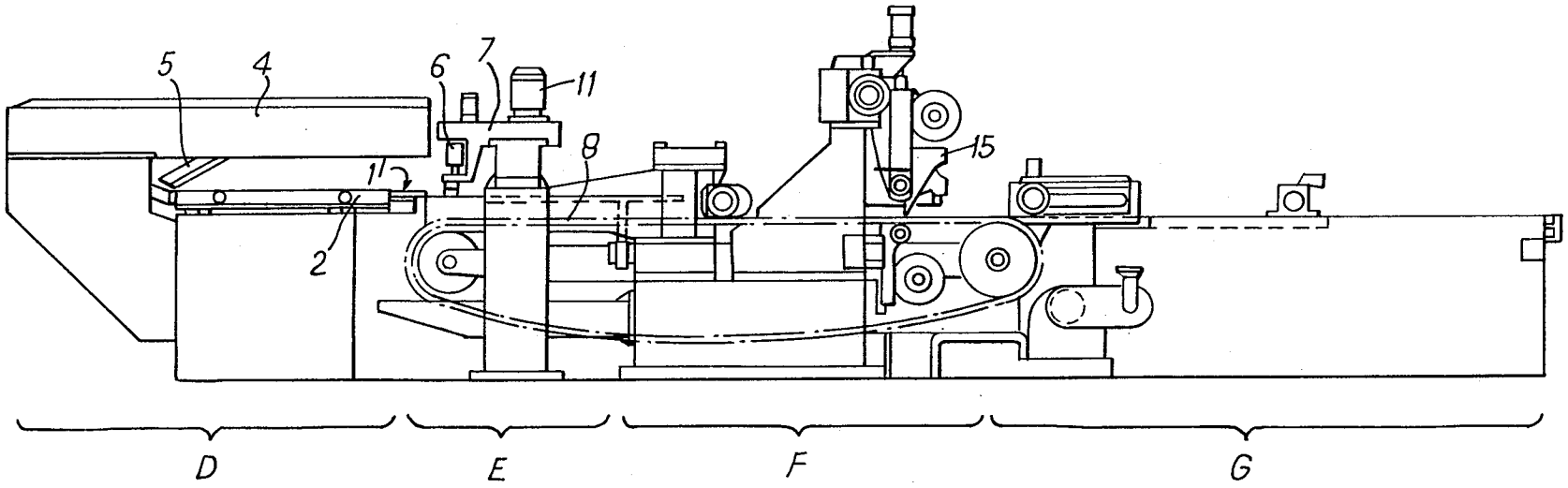
FIG. 2 is a side elevation of a machine for carrying out the method of the invention.
Figure 3:
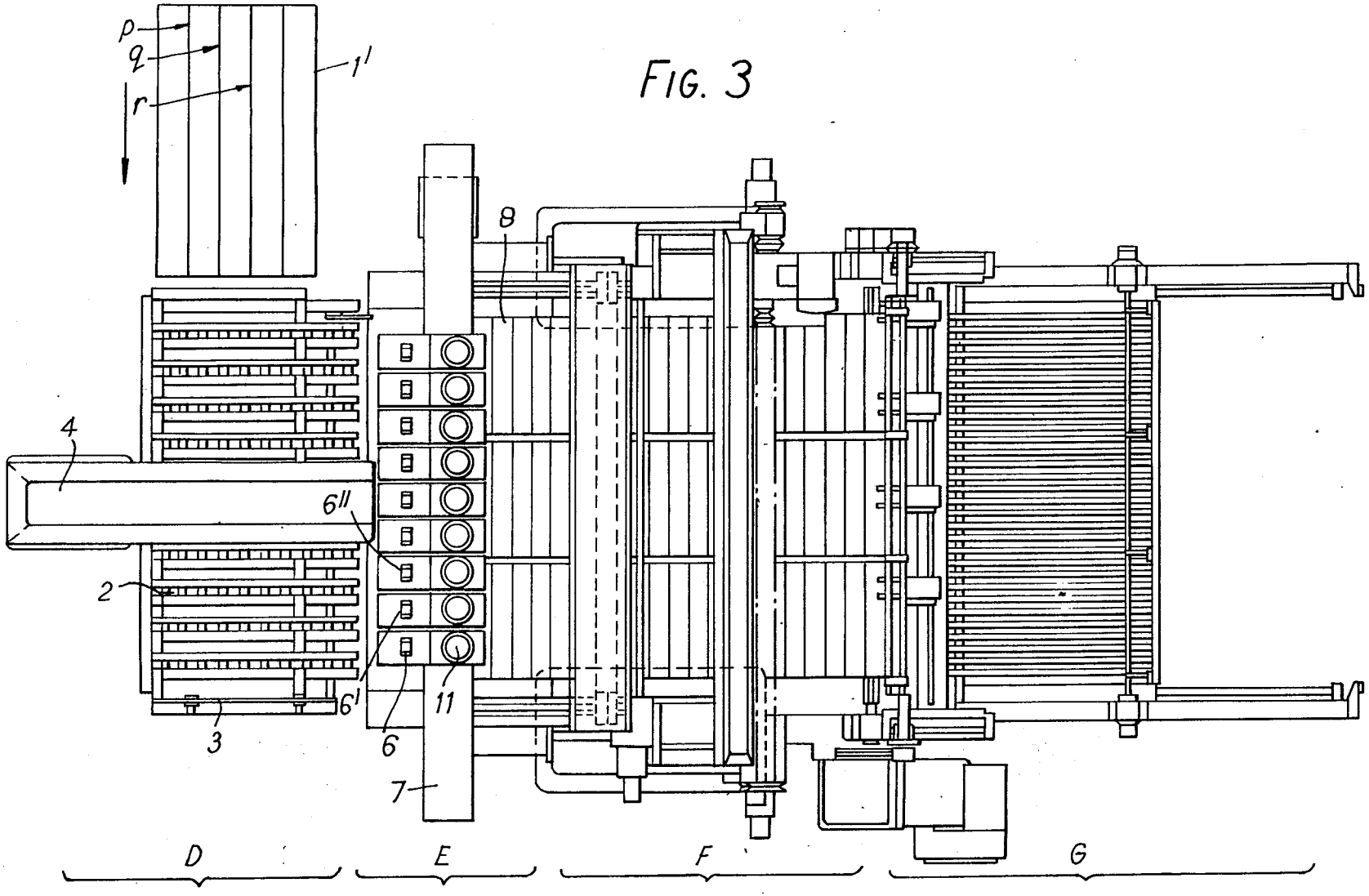
FIG. 3 is a plan view of the machine.

In FIG. 2 (side elevation) and in FIG. 3 (plan view), portions D, E and F are those which are used for the purpose of carrying out a new method stage which is different from the conventional method. Portion D receives the sheet 1' on which longitudinal grooves are provided in the aforementioned stage, and the sheet 1' then slides on a roller shaft 2 and is stopped by a stop member 3. The sheet is then pushed to the portion E, in the horizontal direction, by a claw 5 of a forwarding device 4. In the portion E, there are provided a large number of routers 6, 6', 6'', . . . . arranged in a row and supported by a frame 7, the routers operating in a direction which is transverse to the longitudinal grooves of the sheet 1', which has been forwarded from portion D. While the sheet 1' is being engaged and transported over a belt 8, the said routers 6, 6', 6'', . . . . come down selectively at the required moment and form the transverse grooves p', q', r', . . . . between respective adjacent pairs of the longitudinal grooves p, q, r, . . . .

Figure 4:
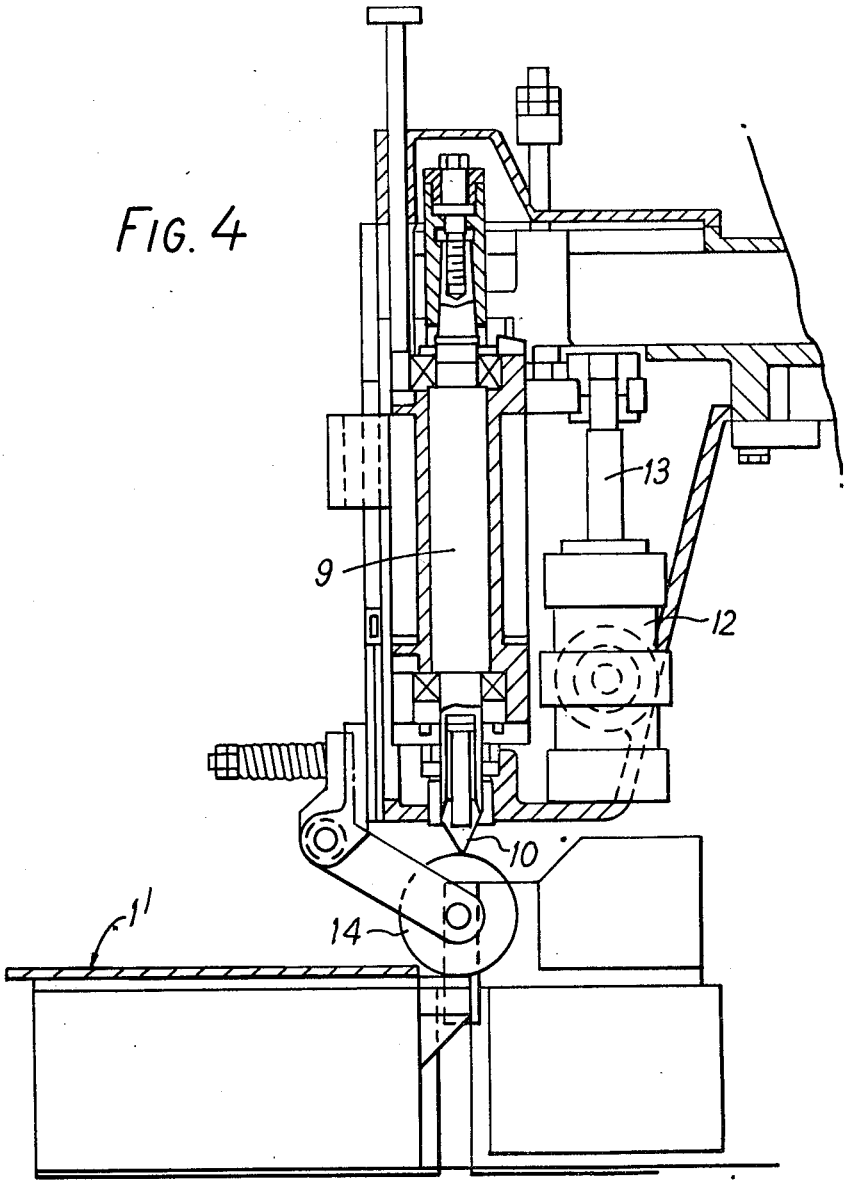
FIG. 4 is a side elevation of a detail of the machine, to show the construction and operation of one of a plurality of routers.

The routers 6, 6', 6'', . . . . are constructed as shown in detail in FIG. 4. At the tip of a rod 9, there is provided a routing cutter 10. The rod 9 is caused to rotate by means of a motor 11, and it is connected integrally with a piston 13 movable in a cylinder 12. When an induction ring 14 contacts a terminal at the front of the sheet 1', it is controlled by an NC circuit and the router blade 10 rotates and comes down for a predetermined period. The NC circuit is so arranged that the routers 6, 6', 6'', . . . . are lowered or elevated at periods corresponding to the dimensional intervals of the longitudinal grooves which have been prepared in stage B, and the operation of the cylinder 12 and motor 11 is controlled in such a manner as to prepare such transverse grooves as will cross directly from a fixed position in the said longitudinal groove to a fixed position in the next longitudinal groove, with the routers 6, 6', 6''. . . . coming down not all at the same time but in selected order and grouping. Accordingly, transverse grooves *p', q', r'*. . . . will be provided between the various longitudinal grooves *p, q, r,* . . . . on the sheet 1' as a whole, (see FIG. 5).

Figure 5:
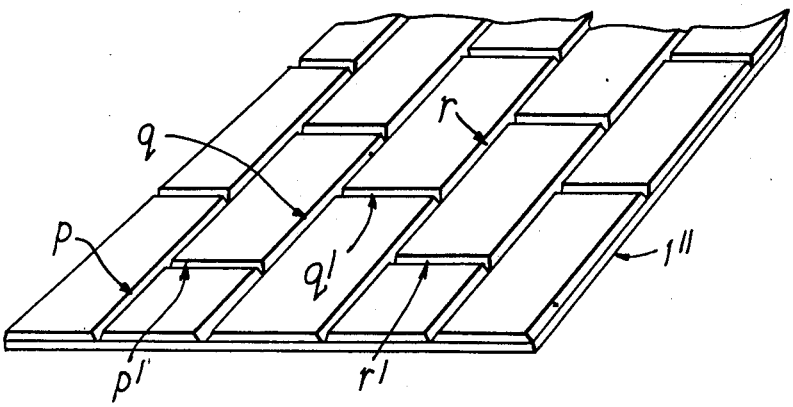
FIG. 5 is a perspective elevation of a sheet material produced in accordance with the invention.

Next, the sheet on which the transverse grooves *p', q', r',* . . . . have been prepared is given a coating, like the longitudinal grooves, in each of said transverse grooves *p', q', r',* . . . . at the portion F. After this, both ends of the sheet are cut by a cutter 15 so as to have a fixed dimension, and the sheet is forwarded to the delivery portion G. FIG. 5 is a perspective view of the sheet 1' prepared in this manner.

In carrying out the method of this invention, the longitudinal grooves are prepared by circular saws, as in the past. However, the transverse grooves are made by routers. Since they are prepared by the router blade 10 of the router, there is no possibility of a sloping cut-in portion being left at the crossing of the longitudinal grooves and horizontal grooves, with a result that the grooves meet in a neat manner.

It is possible to prepare, with high efficiency, sheets 1' which look like sheets with individual blocks secured thereon, by providing transverse grooves which cross the longitudinal grooves at a right angle.

In the above-described example, the thin single strips 2, *a, a', a''*, . . . . have been described as pasted on a veneer sheet 6. However, it is also possible to paste a single thin sheet of paper on a veneer sheet as a whole, or the method may be used for the purpose of producing transverse grooves which cross the longitudinal grooves on a printed veneer sheet. In addition, a chipboard or a hardboard, etc. can be used as the base sheet.

So far as concerns the width and depth of the grooves which are prepared in accordance with the method of this invention, it is desirable that, both for the longitudinal and transverse grooves, the width of the grooves shall be in the range from two and six millimeters inclusive and the depth shall be in the range from 1.5 and these millimeters inclusive. When the grooves have these dimensions, the zones which are surrounded by the longitudinal and transverse grooves have a cubic relief appearance and look similar to blocks pasted on a support.

Accordingly, it is possible to use the product of the invention by arranging such sheets not only in a vertical position but also in a horizontal position, thereby expanding the possible field of use and increasing its practical utility. In the case of those grooves which lie in the longitudinal direction alone, it was previously necessary to discard those which were too short to reach the dimensions of the veneer sheet. According to the method of this invention, however, since it is possible easily to prepare the grooves in the transverse direction, it is possible to utilize those which are short in dimensions. In this manner, the invention contributes to effective utilization of the materials used, thereby improving economy.

We claim:

1. Apparatus for preparing a grooved veneer plywood and hardboard sheet material, comprising:

i. a plurality of groove-forming devices disposed in a row ii. means for causing relative feeding movement, normally to said row of devices, of a sheet of said material having provided in a major face thereof a plurality of first parallel grooves disposed in a first direction parallel to said row iii. a plurality of shifting means coupled one to each of said groove-forming devices and adapted to shift the respective groove-forming device into and out of operative engagement with said major face of said sheet material, and iv. control means connected to each of said plurality of shifting means and arranged to cause shifting of selected ones of said groove-forming devices into operative engagement with said sheet material and simultaneously to cause shifting of other selected ones of said groove-forming devices out of operative engagement with said sheet material, according to the relative position of the sheet material in the feeding direction, thereby to permit the forming in said major face of the material of a plurality of second parallel grooves disposed in a second direction normal to said first direction, at least one of said second grooves being intermittent and formed in a first series of alternately spaced lands of said major face, at least another of said second grooves being intermittent and formed in a second series of alternately spaced lands situated intermediate the lands of said first series of lands.

2. Apparatus, as claimed in claim 1, wherein said groove forming devices are routers.

3. Apparatus, as claimed in claim 1, wherein said groove-forming devices are routers, and wherein said shifting means are fluid operable piston and cylinder devices coupled one to each said router for individually shifting said router into a raised inoperative position and a lowered operative position.

4. Apparatus, as claimed in claim 3, wherein said control means comprises contacting means adapted to be operated by contact with the sheet material, and electrical actuating means operable by said contacting means and connected to said piston and cylinder devices for shifting and operation of individual routers.

* * * * *